US010697115B1

(12) United States Patent
Lin

(10) Patent No.: US 10,697,115 B1
(45) Date of Patent: Jun. 30, 2020

(54) METHOD FOR DYEING ARTIFICIAL FIBERS

(71) Applicant: DingZing Advanced Materials Inc., Kaohsiung (TW)

(72) Inventor: Keng-Hsien Lin, Kaohsiung (TW)

(73) Assignee: DingZing Advanced Materials Inc., Kaohsiung (TW)

( * ) Notice: Subject to any disclaimer, the term of this patent is extended or adjusted under 35 U.S.C. 154(b) by 0 days.

(21) Appl. No.: 16/442,513

(22) Filed: Jun. 16, 2019

(51) Int. Cl.

| | |
|---|---|
| ***D06P 1/00*** | (2006.01) |
| ***D06P 1/54*** | (2006.01) |
| ***D06B 3/02*** | (2006.01) |
| ***D06B 23/02*** | (2006.01) |
| ***D06P 5/20*** | (2006.01) |
| *D06P 3/79* | (2006.01) |
| *D06P 3/24* | (2006.01) |

(52) U.S. Cl.
CPC ..... *D06P 1/54* (2013.01); *D06B 3/02* (2013.01); *D06B 23/021* (2013.01); *D06P 5/2061* (2013.01); *D06B 2700/36* (2013.01); *D06P 3/246* (2013.01); *D06P 3/796* (2013.01)

(58) Field of Classification Search
CPC ..... D06P 1/24; D06P 1/0016; D06P 5/2061; D06P 3/246; D06B 23/021; D06B 2700/35; D06B 2700/36
See application file for complete search history.

(56) References Cited

U.S. PATENT DOCUMENTS

2010/0047531 A1* 2/2010 Baum ..... C09B 67/0013 428/195.1

FOREIGN PATENT DOCUMENTS

TW 2006-39218 B 11/2006
TW 2010-24497 A 7/2010

OTHER PUBLICATIONS

ESpaceNet English Abstract for TW2006-39218, Nov. 16, 2006.
ESpaceNet English Abstract for TW2010-24497, Jul. 1, 2010.

* cited by examiner

*Primary Examiner* — Eisa B Elhilo

(57) ABSTRACT

A method for dyeing artificial fibers comprises preparing an artificial fiber, and adding a dyestuff, a crosslinking agent, and an appropriate amount of water into a tank for mixture. Then, the artificial fiber is immersed in the tank to obtain a dyed artificial fiber, and the dyed artificial fiber is pressed by a roller set. Finally, the dyed artificial fiber is dried out.

9 Claims, 2 Drawing Sheets

METHOD FOR DYEING ARTIFICIAL FIBERS

BACKGROUND OF THE INVENTION

1. Field of the Invention

The present invention relates to a method for dyeing artificial fibers, more particularly to a method with characteristic of low liquor ratio, low energy consumption which is less harmful to the environment.

2. Description of the Prior Art

Artificial fibers, widely known as polyester and nylon, have better ductility, waterproof and anti-fouling than natural fibers, and are used in clothing, home life, automotive textiles, industrial textiles or travel goods, among which it is widely used in textile industry. In order to cope with the color needs of various industries, dyeing is necessary for textile industry and color accuracy is one of the primary jobs to start an order execution.

However, artificial fibers are hydrophobic fibers lacking hydrophilic groups, and the dye molecules are not easy to enter the artificial fibers, so auxiliary methods such as high temperature and high-pressure dyeing, are required to improve poor dyeability. In general, polyester fibers can be dyed at a high temperature of 130° C. to 135° C. and high pressure, so the hue will be uniform, and the color fastness can be maintained at level 3 or above, but it results in high energy usage. While the dyeing temperature of nylon is around 95° C.~100° C., and the temperature needs to be maintained for more than 40 minutes, which is time-consuming and results in low dyeing efficiency. In addition to the long-lasting problem of poor color fastness caused by artificial fibers' chemical structure, and dye leveling and migration are also confined to liquor ratio.

Please refer to the Taiwan invention Patent No. 1304831 "Reaction Dye Composition and Their Use", in which although the dyeing temperature didn't have to reach 100° C., but the sodium carbonate is needed to add into the dye liquor and is heated to 60° C. till the dyeing is finished. The dyeing takes about one hour. After dyeing is completed, it would need abundant water for washing, soaping and drying, so the resources and energy will be consumed during the whole process.

With the advanced technology, the dyeing time is gradually reduced, but the washing step occurring after dyeing still cannot be skipped. Please refer to the Taiwan invention Patent No. 1404847 "Surface Treatment Method for Polyester Substrate", which disclosed that the polyester substrate is heated first, so that the surface of the polyester substrate having low chemical activity can be easily dyed, and the dyeing time can be shortened to within 1 minute. However, it takes 10 seconds to 5 minutes for heat treatment with temperature set between 100° C. and 180° C., and the subsequent washing step is required to wash out the dyestuff on the dyed product, which produces high volumes of wastewater.

It is well known that the dyeing is the most polluting process of the textile industry, which consumes considerable amount of water and chemicals and discharge dyeing wastewater. Dyeing wastewater discharged from the dyeing process contains high chemical oxygen demand (COD) and high suspended solids (SS) with lower biodegradability, which causes contamination of water bodies and is harmful for the environment.

Therefore, the following drawbacks and disadvantages still exist with prior art invention:

1. Energy Consumption

The conventional dyeing method requires a large amount of water for blending dyeing agent, washing dyed clothes or mixing with color fixing agent. Besides, due to the chemical structure of the artificial fibers, high pressure or high temperature is required for better dyeing performance, and it is necessary to purchase specific dyeing machines. During the dyeing process, it is important to maintain high pressure and high temperature, but it will consume abundant energy and increase cost.

2. High Cost of Color Sample

Color trend could be affected by seasons and fashion theme, and due to different color requirements of various industries, it is difficult to prepare all color masterbatch in advance. Moreover, the dyeing process of color sample is the same as the bulk dyeing, and determined percentage of dye liquor is required, so energy and cost cannot be reduced. If the color sample isn't approved by customer, it cannot be reused and will lead to factory stockpile.

3. Unfavorable Environmental Protection

Each stage of conventional dyeing process requires a large amount of chemical agents as well as water, so it is evitable to produce lots of waste water, which contains high chemical oxygen demand and high suspended solids with lower biodegradability. Moreover, it consumes energy and be harmful for the environment.

Therefore, it is desirable to provide a dyeing method with low energy consumption, dyeing time and better dyeing efficiency, moreover, to reduce environmental pollution.

SUMMARY OF THE INVENTION

Therefore, an objective of an embodiment of the present invention is to provide a method for dyeing artificial fibers.

In order to achieve the above-mentioned objective, the method for dyeing artificial fibers comprises a preparation step, a mix step, a dye step, a press step and a dry step.

The preparation step is performed to prepare an artificial fiber. Then, the mix step is performed to add a dyestuff, a crosslinking agent, and an appropriate amount of water into a tank for mixture to obtain a dye liquor. Next, the dye step is performed to immerse the artificial fiber in the tank to obtain a dyed artificial fiber. Then, the press step is performed to press the dyed artificial fiber by a roller set, wherein the roller set has two rollers oppositely disposed. Finally, the dry step is performed to dry out the dyed artificial fiber.

Another technique of an embodiment of the present invention is that in the mix step, the weight percentage of the dyestuff is between 0.01% and 10%, the weight percentage of the crosslinking agent is between 0.01% and 30%, the weight percentage of the water is between 60% and 99.8%.

Another technique of an embodiment of the present invention is that in the mix step, the dyestuff comprises a chromophore, an auxochrome containing —OH or —$NH_2$, and —NCO is included in the crosslinking agent.

Another technique of an embodiment of the present invention is that the mole ratio of —NCO to —OH is between 1 and 50, and the dye liquor can be stored for 0.5 to 24 hours.

Another technique of an embodiment of the present invention is that the dye step further includes a pressing member disposed above the tank, and the height of the pressing member can be adjusted relative to the tank, and the number of the tank can be plural.

Another technique of an embodiment of the present invention is that in the dye step, the duration of dyeing the artificial fiber is less than 5 seconds.

Another technique of an embodiment of the present invention is that the color fastness of dyed artificial fiber is at least Grade 3.

Another technique of an embodiment of the present invention is that the present invention further comprises a roll step that occurs after the dry step to roll up the dyed artificial fiber.

Another technique of an embodiment of the present invention is that the present invention further comprises a cut step that occurs after the roll step to cut the rolled-up artificial fiber at an appropriate length, so that a finished product is obtained, and the overall production speed of the present invention is 3~30 meters/min.

Another technique of an embodiment of the present invention is that the artificial fiber is selected from a set consisting of poly urethane (PU), poly tetra fluoro ethylene (PTFE), thermoplastic poly urethane (TPU), thermal plastic elastomer (TPE), polyamide fiber and combinations thereof.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
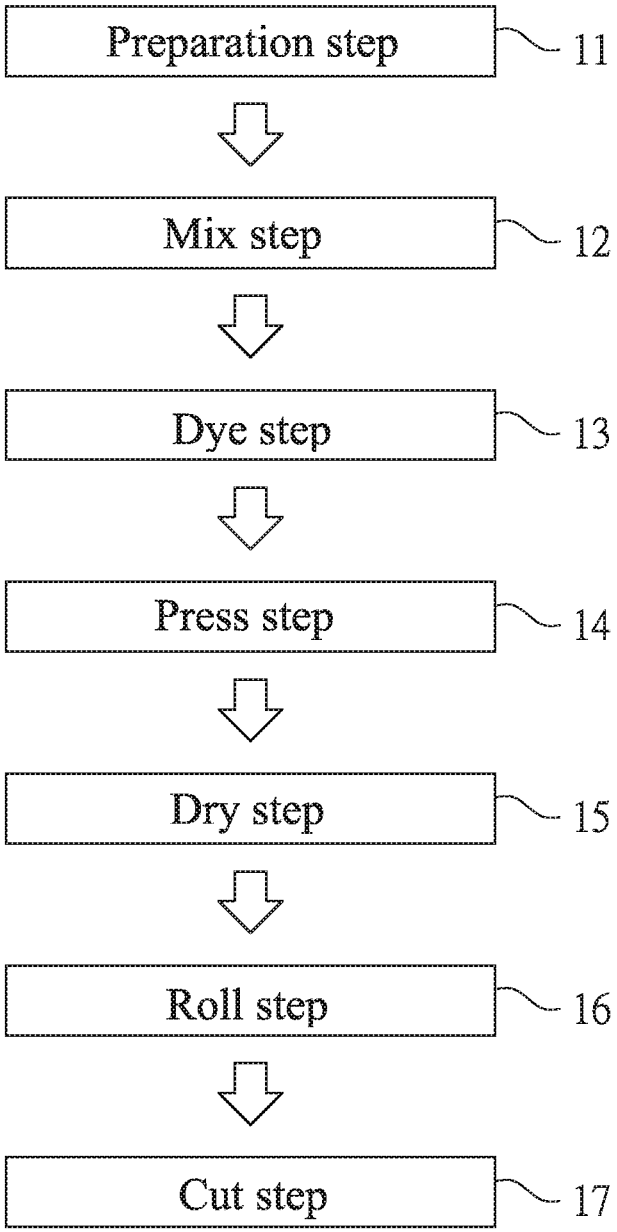
FIG. 1 is a flow chart of a method for dyeing artificial fibers according to an embodiment of the present invention.
Figure 2:
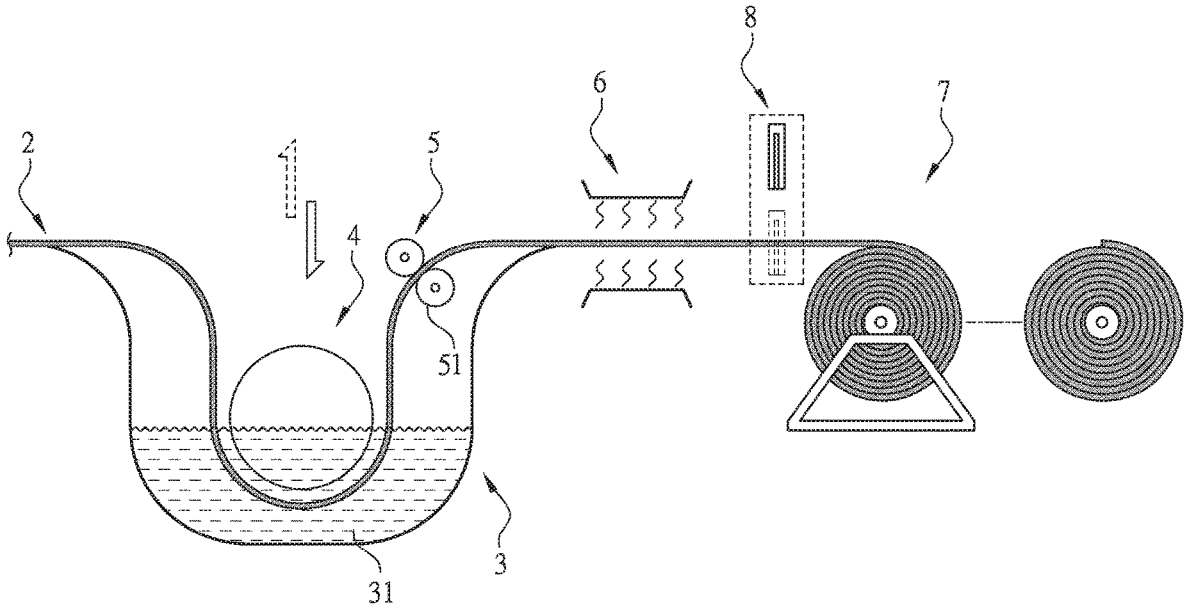
FIG. 2 is a cross-sectional view of a method for dyeing artificial fibers according to an embodiment of the present invention.

Please refer to FIG. 1 and FIG. 2. A method for dyeing artificial fibers comprises a preparation step 11, a mix step 12, a dye step 13, a press step 14 and a dry step 15.

The preparation step 11 is performed to prepare an artificial fiber 2, wherein the artificial fiber 2 is selected from a set consisting of poly urethane (PU), poly tetra fluoro ethylene (PTFE), thermoplastic poly urethane (TPU), thermal plastic elastomer (TPE), polyamide fiber and combinations thereof. In actual implementation, different artificial fiber 2 can be chosen based upon the user's requirement and shall not be construed as limiting the invention.

The mix step 12 is performed to add a dyestuff, a crosslinking agent, and an appropriate amount of water into a tank 3 for mixture to obtain a dye liquor 31, and its temperature is between 20° C.~40° C. Preferably, the dye liquor 31 is only required to be at normal temperature. The weight percentage of the dyestuff is between 0.01% and 10%, the weight percentage of the crosslinking agent is between 0.01% and 30%, and the weight percentage of the water is between 60% and 99.8%. The dyestuff comprises a chromophore, an auxochrome containing —OH or —$NH_2$. The dyestuff can be an acid dye, a reactive dye or the other dyestuffs depending on the required color, and the so-called chromophore is the part of a molecule responsible for its color. The color that is seen by our eyes is the one not absorbed within a certain wavelength spectrum of visible light. Besides, —NCO is included in the crosslinking agent—The mole ratio of —NCO to —OH is between 1 and 50, and the dye liquor 31 can be stored for 0.5 to 24 hours for reuse. The dyeing effect is not affected when it is reused.

The dye step 13 is performed to immerse the artificial fiber 2 in the tank 3 to obtain a dyed artificial fiber 2. The dye step 13 further includes a pressing member 4 disposed above the tank 3, and the height of the pressing member 4 can be adjusted relative to the tank 3. If the volume of the dye liquor 31 in the tank 3 is decreased, the pressing member 4 can move toward the tank 3 for extension, so that the artificial fiber 2 can be fully immersed in the dye liquor 31 to reduce wastewater. On the other hand, if the volume of the dye liquor 31 in the tank 3 is increased, the pressing member 4 can move in the opposite direction of the tank 3 to rise up, so that the artificial fiber 2 can be appropriately immersed in the dye liquor 31 to prevent from overdyeing. Therefore, there is no need to maintain a certain liquor ratio between the artificial fiber 2 and the dye liquor 31. As long as the dye liquor 31 in the tank 3 maintains a certain dyeing concentration, the position of the artificial fiber 2 in the tank 3 can be adjusted by the pressing member 4, so that the effect of low liquor ratio can be obtained.

Preferably, in the dye step 13, the number of the tank 3 can be plural, so that the artificial fiber 2 can undergo the dye steps 13 twice to deepen the color, so as to match different color requirements.

In the dye step 13, the duration of dyeing the artificial fiber 2 is less than 5 seconds, so that continuous dyeing can be achieved. Compared with the conventional dyeing method, the prior art method is necessary to immerse the substrate in the dye liquor 31 for several minutes or even longer for several hours. Therefore, the present invention can effectively shorten the dyeing time and improve the dyeing efficiency.

The press step 14 is performed to press the dyed artificial fiber 2 by a roller set 5, wherein the roller set 5 has two rollers 51 oppositely disposed, so that the dyed artificial fiber 2 can be flattened and dehydrated to reduce creases and facilitate subsequent drying and setting. In actual implementation, multiple sets of rollers 51 can also be set to obtain better flattening and water removal effects.

The dry step 15 is performed to dry out the dyed artificial fiber 2, which is dried at 120° C.-180° C. for 30 minutes. In actual implementation, a dryer 6 can be used for drying to maintain color.

It is worth mentioning that there are different test standards for color fastness from country to country, such as Chinese National Standards (CNS), American Association of Textile Chemists and Colorists (AATCC), Japanese Industrial Standards (JIS), International Standards (ISO), German Standards (DIN), British standards (BS). In the preferred embodiment, the dyed artificial fiber 2 is tested for color fastness by the AATCC 61-II A standard, and its color fastness is up to Grade 3 or higher with no obvious fading or discoloration.

The present invention further comprises a roll step 16 that occurs after the dry step 15 to roll up the dyed artificial fiber 2. In actual implementation, a reeling machine 7 can be used for winding which can reduce creases and is convenient for subsequent use.

The present invention further comprises a cut step 17 that occurs after the roll step 16 to cut the rolled-up artificial fiber at an appropriate length, so that a finished product can be obtained. In actual implementation, a cutting machine 8 can be used for cutting.

The overall production capacity of the present invention can reach a production speed of 3 to 30 meters/min. The production speed is affected by the size of the dryer 8. For example, if the dryer 8 is larger used in the dry step 15, more substrates can be processed by the dryer 8 to shorten the production time and increase the production speed to 30 meters/min. Conversely, if the dryer 8 is smaller used in the dry step 15, less substrates can be processed by the dryer 8 to prolong the production time and reduce the production speed to 3 meters/min. The size of the dryer 8 can be determined by the user according to the actual production environment, and the details will not be further described herein. Based upon thicknesses and elasticity of the artificial fiber 2, the roll step 16 can control the dyeing duration of the artificial fiber 2 in the tank 3 through adjusting the rolling speed of the machine, so that continuous dyeing and bulk dyeing can be achieved.

With above description, the method for dyeing artificial fibers of the embodiment of the present invention has following benefits:

1. Saving Energy

Through different proportions of dyestuff, crosslinking agent, and water, different artificial fibers can be dyed with various colors. The dye step 13 can be carried out at room temperature without the need for high temperature, so that electricity cost and energy consumption can be reduced. In addition, with the pressing member 4, it is possible to adjust the position of the substrate based upon the volume of the dye liquor 31, so that the effect of low liquor ratio can be achieved, and the color fastness can reach Grade 3 or higher.

2. Improving Performance

The dye step 13 shortens the dyeing time, improves the dyeing efficiency, but not worsens the dyeing effect. The press step 14, the dry step 15, the roll step 16, and the cutting step 17 are performed by a continuous operation and facilitate the subsequent transportation and utilization of the artificial fiber 2.

3. Environmental Sustainability

The dyestuff used in the present invention does not contain or produce harmful chemistry and is biodegradability. Moreover, the dyestuff does not contain persistent organic pollutants to achieve environmental sustainability.

In conclusion, the present invention can use different dyestuff to meet the color requirement of different artificial fiber 2. There is no limitation on color election, and the bulk dyeing quality is stable. Through the present invention, the artificial fiber 2 does not lose its permeability and texture during dyeing, but the color fastness tested by AATCC 61-II A standard can still reach Grade 3 or higher. In addition, the artificial fiber 2 was undergone a series of dyeing processes, such as preparation step, mix step, dye step, press step, dry step, roll step, and cut step, and the efficiency of the process is improved by continuous operation to obtain the dyed artificial fiber 2. The overall dyeing process and time can be shortened, moreover, the dyestuff can be reduced, and because of the small amount of water, less wastewater is discharged. The purpose of environmental friendliness and enhancing the competitiveness of the market can be obtained by the present invention.

Although the present invention has been explained in relation to its preferred embodiment, it is to be understood that many other possible modifications and variations can be made without departing from the spirit and scope of the invention as hereinafter claimed.

What is claimed is:

1. A method for dyeing artificial fibers comprising:

a preparation step to prepare an artificial fiber;

a mix step to add a dyestuff, a crosslinking agent, and water into a tank for mixture to obtain a dye liquor;

a dye step to immerse the artificial fiber in the tank to obtain a dyed artificial fiber;

a press step to press the dyed artificial fiber by a roller set, wherein the roller set has two opposing rollers; and a dry step to dry out the dyed artificial fiber;

wherein in the mix step, the weight percentage of the dyestuff is between 0.01% and 10%, the weight percentage of the crosslinking agent is between 0.01% and 30%, and the weight percentage of the water is between 60% and 99.8%.

2. The method as claimed in claim 1, wherein in the mix step, the dyestuff comprises a chromophore, an auxochrome containing OH or —NH2, and —NCO is included in the crosslinking agent.

3. The method as claimed in claim 2, wherein the mole ratio of —NCO to OH is between 1 and 50, and the dye liquor can be stored for 0.5 to 24 hours.

4. The method as claimed in claim 3, wherein the dye step further includes a pressing member disposed above the tank, and a height of the pressing member is adjustable relative to the tank, and the tanks includes one or more tanks.

5. The method as claimed in claim 4, wherein in the dye step, a duration of dyeing the artificial fiber is less than 5 seconds.

6. The method as claimed in claim 5, wherein a color fastness of dyed artificial fiber is at least Grade 3.

7. The method as claimed in claim 6 further comprising a roll step that occurs after the dry step to roll up the dyed artificial fiber.

8. The method as claimed in claim 7, further comprising a cut step that occurs after the roll step to cut the rolled-up artificial fiber at an appropriate length, so that a finished product is obtained, and an overall production speed is 3~30 meters/min.

9. The method as claimed in claim 8, wherein the artificial fiber is selected from a set consisting of poly urethane (PU), poly tetra fluoro ethylene (PTFE), thermoplastic poly urethane (TPU), thermal plastic elastomer (TPE), polyamide fiber and combinations thereof.

* * * * *